US011346141B2

(12) United States Patent
Gregoriou

(10) Patent No.: US 11,346,141 B2
(45) Date of Patent: May 31, 2022

(54) SAFETY SYSTEM AND METHOD FOR OVERHEAD ROLL-UP DOORS

(71) Applicant: Rytec Corporation, Jackson, WI (US)

(72) Inventor: Daniel Gregoriou, Kewaskum, WI (US)

(73) Assignee: RYTEC CORPORATION, Jackson, WI (US)

( * ) Notice: Subject to any disclaimer, the term of this patent is extended or adjusted under 35 U.S.C. 154(b) by 139 days.

(21) Appl. No.: 16/722,530

(22) Filed: Dec. 20, 2019

(65) Prior Publication Data

US 2020/0199928 A1 Jun. 25, 2020

Related U.S. Application Data

(60) Provisional application No. 62/783,765, filed on Dec. 21, 2018.

(51) Int. Cl.
*E05F 15/43* (2015.01)
*G08B 5/36* (2006.01)
(Continued)

(52) U.S. Cl.
CPC ..... *E05F 15/43* (2015.01); *E05F 15/668* (2015.01); *E05F 2015/436* (2015.01);
(Continued)

(58) Field of Classification Search
CPC ..... E05F 15/43; E05F 15/73; E05F 15/668; G08B 5/36; E05Y 2400/52
(Continued)

(56) References Cited

U.S. PATENT DOCUMENTS 2,900,521 A 8/1959 Eames
3,183,499 A 5/1965 Cowen
(Continued)

FOREIGN PATENT DOCUMENTS

CN 205 594 802 9/2016
DE 10 2010 017398 12/2011
(Continued)

OTHER PUBLICATIONS

International Search Report and Written Opinion in related International App No. PCT/US2019/067795 dated Mar. 11, 2020, 13 pages.

(Continued)

*Primary Examiner* — John A Tweel, Jr.
(74) *Attorney, Agent, or Firm* — Schroeder Intellectual Property Law Group, LLC

(57) ABSTRACT

An overhead roll-up door assembly having a door controller, a door panel and a drum on which the door panel is wound and unwound to open and close a doorway, opening and closing of the door being controlled by the controller. The door assembly includes a safety system comprising at least one light, the at least one light being positioned to emit light proximate a first side of the doorway, the light from the at least one light being projected onto a lower boundary of the doorway and forming a strip or stripe proximate the first side of the doorway, wherein emission of the light from the at least one light is controlled by the controller in conjunction with the controller opening and closing the doorway.

12 Claims, 7 Drawing Sheets

(51) Int. Cl.
*E05F 15/668* (2015.01)
*E06B 3/44* (2006.01)

(52) U.S. Cl.
CPC ..... *E05Y 2400/52* (2013.01); *E06B 3/44* (2013.01); *G08B 5/36* (2013.01)

(58) Field of Classification Search
USPC ..... 340/815.4
See application file for complete search history.

(56) References Cited

U.S. PATENT DOCUMENTS

| | | | |
|---|---|---|---|
| 3,670,164 | A | 6/1972 | Hardy et al. |
| 3,746,863 | A | 7/1973 | Pronovost |
| 3,805,061 | A | 4/1974 | De Missimy et al. |
| 4,029,176 | A | 6/1977 | Mills |
| 4,266,124 | A | 5/1981 | Weber et al. |
| 4,452,009 | A | 6/1984 | Baumeler et al. |
| 4,853,531 | A | 8/1989 | Rejc |
| 4,866,881 | A | 9/1989 | Morrow et al. |
| 4,894,952 | A | 1/1990 | Trett et al. |
| 4,914,859 | A | 4/1990 | Gionet et al. |
| 4,967,083 | A | 10/1990 | Kornbrekke et al. |
| 5,001,557 | A | 3/1991 | Begle |
| 5,015,840 | A | 5/1991 | Blau |
| RE33,668 | E | 8/1991 | Gray |
| 5,079,417 | A | 1/1992 | Strand |
| 5,149,921 | A | 9/1992 | Picado |
| 5,193,895 | A | 3/1993 | Naruke et al. |
| 5,225,689 | A | 7/1993 | Bückle et al. |
| 5,302,942 | A | 4/1994 | Blau |
| 5,410,149 | A | 4/1995 | Winston, Jr. et al. |
| 5,428,923 | A | 7/1995 | Waggamon |
| 5,641,951 | A | 6/1997 | Cai et al. |
| 5,925,858 | A | 7/1999 | Full et al. |
| 5,929,580 | A | 7/1999 | Mullet et al. |
| 5,969,637 | A | 10/1999 | Doppelt et al. |
| 6,167,991 | B1 | 1/2001 | Full et al. |
| 6,243,006 | B1 | 6/2001 | Rejc et al. |
| 6,292,100 | B1 | 9/2001 | Dowling |
| 6,304,178 | B1 | 10/2001 | Hayashida |
| 6,354,716 | B1 | 3/2002 | Chen et al. |
| 6,678,999 | B2 | 1/2004 | Zengguang et al. |
| 6,737,968 | B1 | 5/2004 | Ergun et al. |
| 6,756,910 | B2 | 6/2004 | Ohba et al. |
| 6,782,660 | B2 | 8/2004 | Takada et al. |
| 6,812,837 | B2 | 11/2004 | Ikeuchi |
| 6,970,085 | B2 | 11/2005 | Okabe et al. |
| 6,975,226 | B2 | 12/2005 | Reynard et al. |
| 7,044,271 | B2 | 5/2006 | Decoi |
| 7,045,764 | B2 | 5/2006 | Beggs |
| 7,048,422 | B1 | 5/2006 | Solomon |
| 7,064,666 | B2 | 6/2006 | Sasaki et al. |
| 7,071,459 | B2 | 7/2006 | Pustelniak |
| 7,084,388 | B2 | 8/2006 | Rejc |
| 7,140,469 | B2 | 11/2006 | Deplazes et al. |
| 7,154,112 | B2 | 12/2006 | Eubelen |
| 7,161,319 | B2 | 1/2007 | Ergun et al. |
| 7,253,890 | B2 | 8/2007 | Miremadi |
| 7,380,375 | B2 | 6/2008 | Maly |
| 7,495,556 | B2 | 2/2009 | Eubelen et al. |
| 7,533,431 | B2 | 5/2009 | Hochstein et al. |
| 7,762,304 | B2 | 7/2010 | La Marca et al. |
| 7,771,080 | B2 | 8/2010 | Platt |
| 7,900,398 | B2 | 3/2011 | Liles, Jr. |
| 7,940,300 | B2 | 5/2011 | Spinelli |
| 8,077,034 | B2 | 12/2011 | Borlez et al. |
| 8,115,162 | B2 | 2/2012 | Shikai |
| 8,145,351 | B2 | 3/2012 | Schininger et al. |
| 8,309,904 | B2 | 11/2012 | Decoi et al. |
| 8,445,833 | B2 | 5/2013 | Klingelhöfer |
| 8,547,234 | B2 | 10/2013 | Maly et al. |
| 8,575,538 | B2 | 11/2013 | Decoi et al. |
| 8,791,839 | B2 | 7/2014 | Citta et al. |
| 8,833,524 | B2 | 9/2014 | Decoi et al. |
| 8,867,045 | B2 | 10/2014 | Piana et al. |
| 8,875,441 | B2 | 11/2014 | Agam et al. |
| 8,904,708 | B2 | 12/2014 | Zacchio et al. |
| 8,988,213 | B2 | 3/2015 | Leutenegger et al. |
| 9,057,779 | B2 | 6/2015 | Pfiffner |
| 9,163,446 | B2 | 10/2015 | Houser et al. |
| 9,292,136 | B2 | 3/2016 | Pratt et al. |
| 9,341,013 | B2 | 5/2016 | Iwata et al. |
| 9,503,184 | B2 | 11/2016 | Grimm et al. |
| 9,528,312 | B2 | 12/2016 | Shimazu et al. |
| 9,671,523 | B2 | 6/2017 | Gelineau et al. |
| 9,771,225 | B2 | 9/2017 | Stone et al. |
| 9,797,184 | B2 | 10/2017 | Collins et al. |
| 9,830,825 | B2 | 11/2017 | Anstett |
| 9,926,148 | B2 | 3/2018 | Hochstein et al. |
| 9,970,230 | B2 | 5/2018 | Scholten |
| 10,087,049 | B2 | 10/2018 | Collins |
| 10,619,397 | B2 | 4/2020 | Gregoriou |
| 10,746,360 | B2 * | 8/2020 | Brown ..... F21V 21/005 |
| 2004/0160318 | A1 | 8/2004 | Sasaki et al. |
| 2005/0074140 | A1 | 4/2005 | Grasso et al. |
| 2005/0103577 | A1 | 5/2005 | Warner |
| 2006/0022596 | A1 | 2/2006 | Watanabe |
| 2006/0137261 | A1 | 7/2006 | Maly |
| 2006/0162254 | A1 | 7/2006 | Imai et al. |
| 2008/0022596 | A1 | 1/2008 | Boerger et al. |
| 2010/0037522 | A1 | 2/2010 | Wirth |
| 2010/0162629 | A1 | 7/2010 | Wirth |
| 2010/0309007 | A1 | 12/2010 | Goldsmith |
| 2010/0319256 | A1 | 12/2010 | Agam et al. |
| 2011/0203059 | A1 | 8/2011 | Whitley et al. |
| 2011/0284171 | A1 | 11/2011 | Daniele |
| 2012/0194356 | A1 | 8/2012 | Haines et al. |
| 2013/0062511 | A1 | 3/2013 | Decoi et al. |
| 2013/0091768 | A1 | 4/2013 | Houser et al. |
| 2015/0294572 | A1 | 10/2015 | Anslett |
| 2015/0315834 | A1 | 11/2015 | Collins et al. |
| 2016/0040469 | A1 | 2/2016 | Lietz et al. |
| 2016/0047159 | A1 | 2/2016 | Scholten |
| 2016/0284175 | A1 | 9/2016 | Finn et al. |
| 2016/0298373 | A1 | 10/2016 | Lietz et al. |
| 2016/0348429 | A1 | 12/2016 | Frede |
| 2016/0348430 | A1 | 12/2016 | Lorenzani et al. |
| 2016/0376843 | A1 | 12/2016 | Schneider et al. |
| 2017/0074039 | A1 | 3/2017 | Gregoriou |
| 2017/0138111 | A1 | 5/2017 | Lietz et al. |
| 2017/0223254 | A1 | 8/2017 | Brinkman |
| 2017/0254141 | A1 | 9/2017 | Iglesias Ballester |
| 2017/0306696 | A1 | 10/2017 | Slupik et al. |
| 2017/0314314 | A1 | 11/2017 | Collins et al. |
| 2017/0315262 | A1 | 11/2017 | Collins et al. |
| 2018/0002980 | A1 | 1/2018 | Bartole et al. |
| 2018/0096603 | A1 | 4/2018 | Mushynski et al. |
| 2018/0209198 | A1 | 7/2018 | Company |
| 2020/0355014 | A1 | 11/2020 | Gregoriou |

FOREIGN PATENT DOCUMENTS

| | | |
|---|---|---|
| EP | 0598630 | 3/1997 |
| EP | 1626924 | 2/2006 |
| EP | 2256277 | 12/2010 |
| EP | 2292548 | 3/2011 |
| EP | 2374985 | 10/2011 |
| WO | 2014/147292 | 9/2014 |
| WO | 2015/000622 | 1/2015 |
| WO | 2016022534 | 2/2016 |
| WO | 2016/029246 | 3/2016 |

OTHER PUBLICATIONS

FlexiForce ("Force LC2 safety light curtains manual"), 22 pages.

* cited by examiner

SAFETY SYSTEM AND METHOD FOR OVERHEAD ROLL-UP DOORS

RELATED APPLICATIONS

The present application claims priority to U.S. Provisional Patent Application Ser. No. 62/783,765 filed Dec. 21, 2018, the contents of which are fully incorporated herein by reference.

FIELD OF THE INVENTION

The present invention is directed to a safety system and method for overhead roll-up door assemblies, and more particularly to a system and method which projects visible warnings and indicators related to door operation proximate the doorway, for observation by traffic approaching the door.

BACKGROUND OF THE INVENTION

Overhead roll-up door assemblies typically include a flexible door panel which is guided within side columns and/or guide tracks positioned on opposite sides of a doorway as the flexible door panel is opened and closed. In order to move the door panel within the guide tracks, and open and close the door panel, a drum and motor combination is typically used, with the door panel being fixed at one end to the drum. A motor is typically coupled to the drum so that activation of the motor in a first direction causes the drum to rotate in a first direction, and activation of the motor in a second direction causes the drum to rotate in a second direction. As the drum rotates in one direction, the first direction for example, the door panel will begin winding up on the drum over top the doorway, opening the doorway which was previously blocked by the door panel. As the drum rotates in the opposite direction, the second direction for example, the door panel will unwind from the drum, lowering into the opening and closing the previously open doorway.

Insofar as these door panels are typically large and very heavy, the door panels may include a weighted bottom bar attached to the bottom of the door panel which is typically made of metal, steel, aluminum or other similar materials, and the door panel and any bottom bar may be lowered at very high speeds. In order to warn of an impending change in status in the door operation, such door assemblies may include a warning system which indicates to traffic approaching the doorway that the door is about to open and/or close. An exemplary warning system can be seen in U.S. Pat. Pub. No. 2017/0074039 to Rytec Corporation in which strips of LEDs are fixed to the side columns of the door panel. These strips of LEDs are viewable to traffic as it approaches the doorway and provide warnings or indicators if the status or operation of the door is about to change. For example, if an opened overhead roll-up door is about to close, has begun closing, or is nearly closed, the warning lights may light up to indicate the coming or started change in operation. While successful, strips of indicator or warning lights require those approaching the doorway to view the lights themselves, which may require operators of vehicles, for example, to take their eyes off the doorway as they approach the door to check the status of the door panel before proceeding. In environments with foot traffic, individuals approaching the doorway may likewise have to take their eyes off the doorway and any potential oncoming pedestrian or vehicular traffic to view the warning or indicator lights. Any individuals approaching the doorway looking down at something being carried, like for example documents being reviewed or a mobile device, may also fail to view the warning or indicator lights and be struck by a closing door as they approach.

As such, it would be advantageous to provide a warning or indicator system for an overhead roll-up door system in which a warning or status indicator regarding a change in operation or status of a door is projected within the line of sight and pathway of travel of any traffic which approaches the door in a manner wherein the traffic does not have to remove its sight from the doorway being approached, as well as any approaching traffic, in order to view the warning or indicator.

The present invention aims to provide such a system and method.

SUMMARY OF THE INVENTION

The present invention is directed to an overhead door assembly which includes a safety system for providing warnings and indicators to traffic approaching the door proximate the doorway.

According to one aspect of the invention, an overhead roll-up door assembly is provided. The overhead roll-up door assembly includes a door panel, a drum on which the door panel is wound and unwound to open and close a doorway, a motor for rotating the drum to wind and unwind the door panel, and a controller for controlling operation of the motor to wind and unwind the door panel. The overhead roll-up door assembly further includes a safety system having at least one light, the at least one light being positioned to emit light proximate a first side of the doorway. The light emitted by the at least one light may be projected onto an area of a surface proximate a lower boundary of the doorway, and emission of the light from the at least one light may be controlled by the controller in conjunction with the operational control of the motor to wind and unwind, and therefore open and close, the door panel.

The safety system may further include at least a second light, the second light being positioned to emit light on a second side of the doorway. The light emitted from the second light may be projected onto a second area proximate a lower boundary of the doorway, wherein emission of the light from the second light is controlled by the controller in conjunction with the operational control of the motor to wind and unwind, and therefore open and close, the door panel.

Rather than have a second light, in some embodiments of the invention, the at least one light may emit a second light projection directed towards a second area on a second side of the doorway. The second light projection from the at least one light may be projected onto a second area proximate the lower boundary of the doorway on the second side of the doorway. Regardless of whether or not one light projects light on one side of the doorway, one light projects light to both sides of the doorway, or two lights are used to project light, no light may be projected underneath the door panel, in a pathway of the door panel, see as bi-directional arrow D in FIGS. 3 and 5, or within the doorway when the light or lights are activated by the controller.

The light projected onto the first and/or second side of the doorway may take any pattern, and may, for example, be projected as a strip of light, an arc of light, a shape such as a rectangle, semi-circle, circle, or triangle, may be projected as a message or sign, and/or may be projected as a blinking light or solid, unblinking light. Where a strip or shape of light is utilized, the light may extend along at least an entire width of the doorway, and preferably may extend beyond the width and outer edges of the doorway, so that traffic approaching the door from any direction can see and pass through the light prior to reaching the doorway. Where a circular shape such as an arc, circle, or semi-circle is used, the light projected on the first and/or second areas may begin proximate, i.e. just outside, a first side or edge of the doorway, and end proximate, i.e. just outside, a second side or edge of the doorway.

According to one aspect of the invention, a method of increasing safety for overhead roll-up doors is provided. The method includes providing a first light on a first side of a doorway opened and closed by a door panel, positioning the first light to project light onto an area of a surface proximate a lower boundary of the doorway proximate the first side of the doorway, and controlling the first light so that the first light projects light onto the area in conjunction with the door panel opening and closing the doorway.

In order to provide a light warning on both sides of the doorway, a second light beam or projection may be emitted from the first light and projected onto a second surface proximate the lower boundary of the doorway proximate a second side of the doorway. The second light beam or projection from the first light may be controlled so that the second light is projected onto the second surface in conjunction with the door panel opening and closing the doorway.

Rather than provide two beams from a single light, a second light may be provided on a second side of the doorway. The second light may be positioned to emit light which is projected onto a second area proximate the lower boundary of the doorway proximate the second side of the doorway, and controlled so that the second light projects light onto the second area in conjunction with the door panel opening and closing the doorway.

Where two lights are used, the first and second lights may be controlled and activated by transmitting a first signal generated by a controller to each of the first light and the second light when an instruction to open the door panel is received by the controller. The first signal may cause each of the first light and the second light to emit and project light in a first pattern and/or color prior to the door panel opening. The first and second lights may be further controlled and activated by transmitting a second signal generated when the door panel begins to open. The second signal may cause each of the first light and the second light to emit and project light in a second pattern and/or color while the door panel is opening. Prior to the door panel being closed, the first and second lights may be controlled and activated by transmitting a third signal generated by the controller to each of the first light and the second light when an instruction to close the door panel is received. The third signal may cause each of the first light and the second light to emit and project light in a third pattern and/or color prior to the door panel closing. Once the door panel begins closing, the first and second lights may be controlled by transmitting a fourth signal to each of the first light and the second light when the door panel begins closing. The fourth signal may cause each of the first light and the second light to emit and project light in a fourth pattern and/or color while the door panel is closing. In some instances, the first pattern and/or color and the third pattern and/or color may be identical, and the second pattern and/or color and the fourth pattern and/or color may be identical.

In addition to being controlled and activated immediately prior to and during movement of the door panel, the first and second lights may be further controlled and activated by transmitting a fifth signal when a system fault is detected. The fifth signal may cause the first light and the second light to emit and project light in a fifth pattern and/or color until the system fault is resolved.

In order to provide further control and enhanced warnings to traffic approaching the door panel, the control and activation of the first and second lights may be modified by transmitting an intermediate signal generated by the controller to the first light and the second light. The intermediate signal may be generated and transmitted after the first signal and modify the first pattern and/or color of light emitted and projected by the first light and the second light to indicate a more imminent change in status of the door and/or movement of the door panel.

Similarly, the first and second lights may be controlled and activated by transmitting an intermediate signal generated by the controller to the first light and the second light after the third signal to modify the third pattern and/or color of light emitted and projected by the first light and the second light to indicate a more imminent change in status of the door and/or movement of the door panel.

A similar control and activation method may be utilized when just a single light is used in the system. For example, the first light may be controlled and activated by transmitting a first signal generated by a controller to the first light when an instruction to open the door panel is received, with the first signal causing the first light to emit and project light in a first pattern and/or color prior to the door panel opening. The first light may be controlled and activated once the door panel begins opening by transmitting a second signal to the first light when the door panel begins opening, with the second signal causing the first light to emit and project light in a second pattern and/or color while the door panel is opening. When the door panel is about to or actually closing, the first light may be controlled in a similar manner. For example, the first light may be controlled and activated by transmitting a third signal generated by the controller to the first light when an instruction to close the door panel is received or generated, with the third signal causing the first light to emit and project light in a third pattern and/or color prior to the door panel closing. Once the door panel begins closing, the first light may be controlled by transmitting a fourth signal generated to the first when the door panel begins closing, with the fourth signal causing the first light to emit and project light in a fourth pattern and/or color while the door panel is closing. As with two lights, it is contemplated that the first pattern and/or color and the third pattern and/or color emitted by just the first light may be identical, and the second pattern and/or color and the fourth pattern and/or color may also be identical.

The first light may also be activated and controlled by transmitting a fifth signal generated by the controller to the first light when a system fault is detected. The fifth signal may cause the first light to emit and project light in a fifth pattern and/or color until the system fault is resolved.

The further control and enhanced warnings to traffic approaching the door panel using intermediate signals may also be realized with just a first light warning system. For example, the first light may be controlled and activated by transmitting an intermediate signal generated by the controller to the first light, the intermediate signal being generated after the first signal and modifying the first pattern and/or color of light emitted and projected by the first light. The first light may be further controlled by transmitting an intermediate signal generated by the controller to the first light, the intermediate signal being generated after the third signal and modifying the third pattern and/or color of light emitted and projected by the first light. Each of the first, second, third, fourth, and fifth signals, as well as any intermediate signals, may be used whether the single light emits and projects to one area or two areas.

Other advantages and aspects of the present invention will become apparent upon reading the following description of the drawings and detailed description of the invention.

DETAILED DESCRIPTION OF THE PRESENT INVENTION

While this invention is susceptible to embodiments in many different forms, there is described in detail herein, preferred embodiments of the invention with the understanding that the present disclosures are to be considered as exemplifications of the principles of the invention and are not intended to limit the broad aspects of the invention to the embodiments illustrated.

Figure 1:
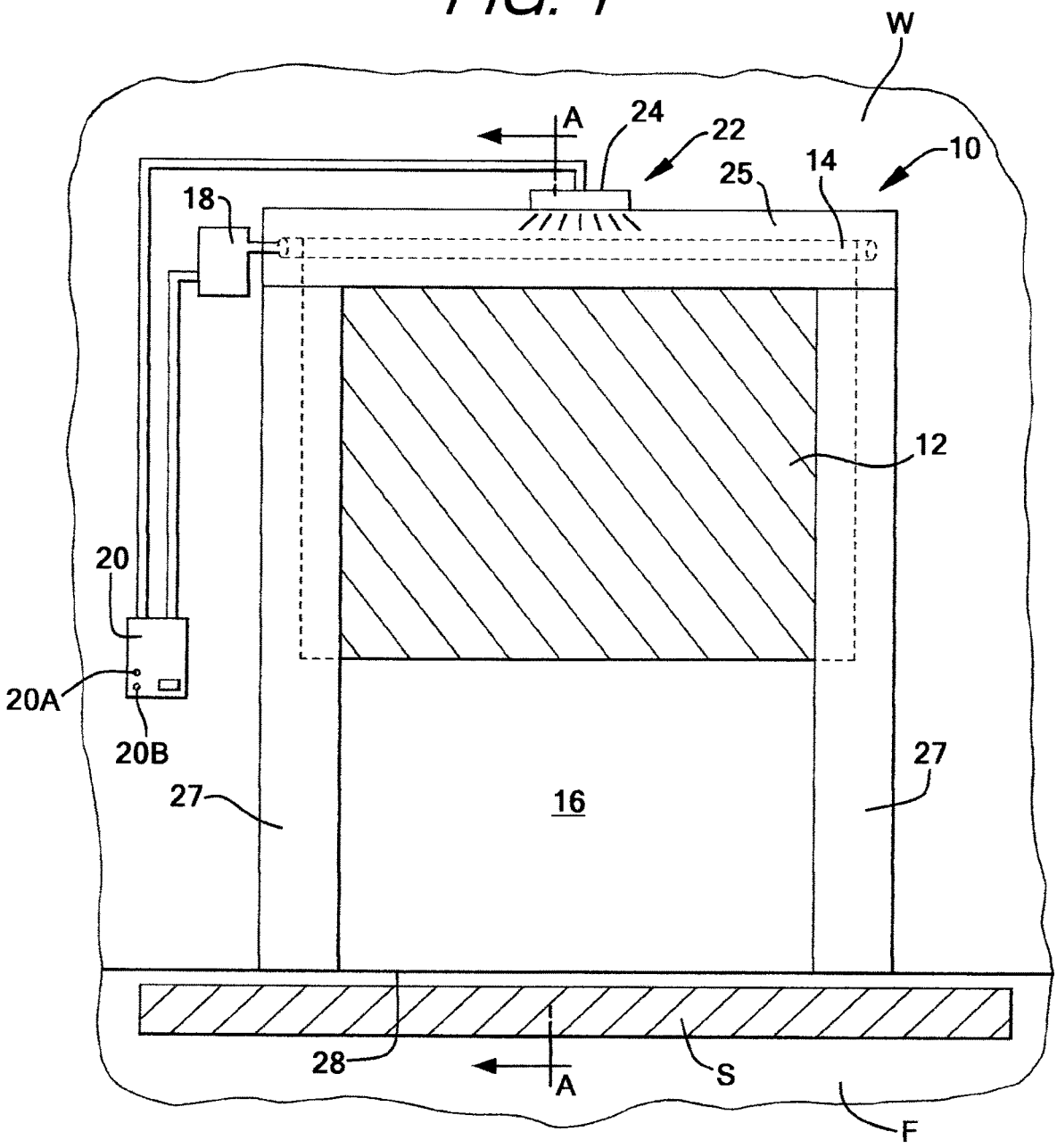
FIG. 1 shows a door assembly according to an embodiment of the invention as seen when looking at a first side of a doorway opened and closed by the door assembly.

FIG. 1 shows an embodiment of a door assembly according to the present invention. As seen in FIG. 1, door assembly 10 includes a door panel 12 which is wound and unwound from a drum 14 in order to open and close a doorway 16 formed in wall W. In order to actuate drum 14, a motor 18 is provided which is capable of rotating drum 14 in a clockwise or counterclockwise direction—rotation in one direction, for example the counterclockwise direction, causing the door panel to wind onto the drum opening the doorway, and rotation in the opposite direction, for example the clockwise direction, causing the door panel to unwind from the drum closing the doorway. In order to control and operate motor 18, a door controller 20 is provided which controls the motor to start and stop opening and closing sequences.

Exemplary controllers which may be used for controller 20 in door assembly 10 include the System 3® and System 4® controllers sold by Rytec Corporation. Door controller 20 may be configured to receive or generate a signal to open or close the door panel, and in response to the receipt or internal generation of the signal, transmit a corresponding signal which activates motor 18 to actuate drum 14 to begin the appropriate operation. Door controller 20 may be configured to receive a manual input to begin an opening or closing sequence, like for example as a result of a user pushing a corresponding button 20A or 20B on the controller, or through the receipt of an infrared or wireless signal from a controller activated by a user. Door controller 20 may also (or alternatively) be configured to begin an opening sequence through the receipt of a signal from a sensor positioned proximate the door panel that traffic is approaching the door assembly, like for example a floor sensor, an optical sensor, a proximity sensor, a motion sensor, a pressure sensor, a camera, or any other sensor which detects traffic approaching the door and is capable of generating a signal in response to the traffic and transmitting the signal to the controller to open or close the door.

Door controller 20 may also (or alternatively) be configured to begin a closing sequence based on an internal clock or countdown after door panel 12 has been opened for a set period of time and no further "open" signal has been received by the door controller. For example, when the controller receives a manually activated or sensor activated signal to open the door panel, the controller may activate the motor to rotate the drum to wind up the door panel and move the door panel to an open position, opening the doorway. Once the door panel is moved to the open position and the controller stops the motor, the controller may begin an internal countdown clock to automatically close the door after a set period of time if no further open signals are received, or if no traffic is sensed proximate the door panel requiring the door panel to stay open where traffic sensors are used to detect approaching traffic, or traffic within close proximity of an open door panel.

Figure 2:
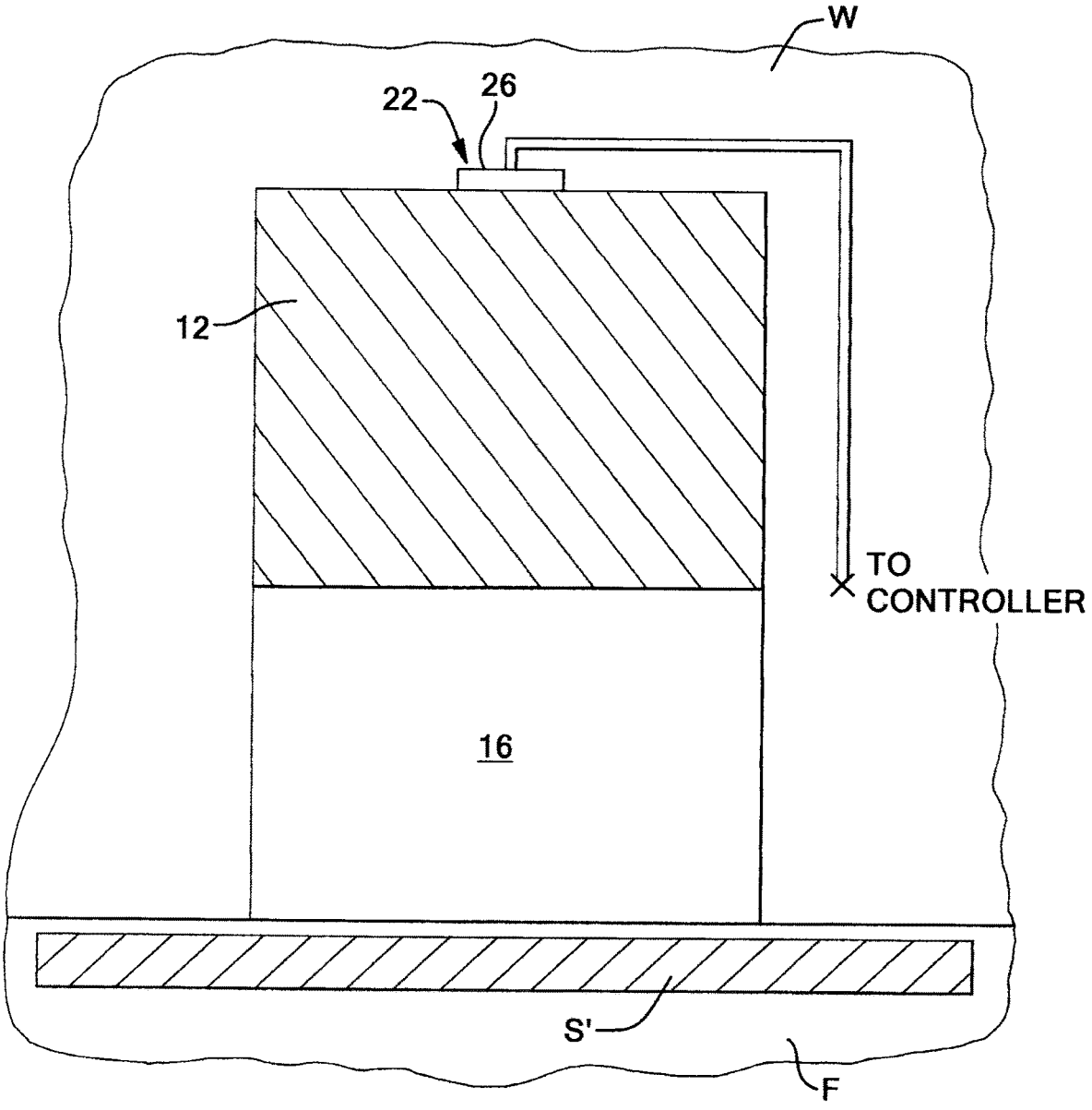
FIG. 2 shows a back view of the door assembly as shown in FIG. 1 when looking at a second side of the doorway opened and closed by the door assembly.
Figure 3:
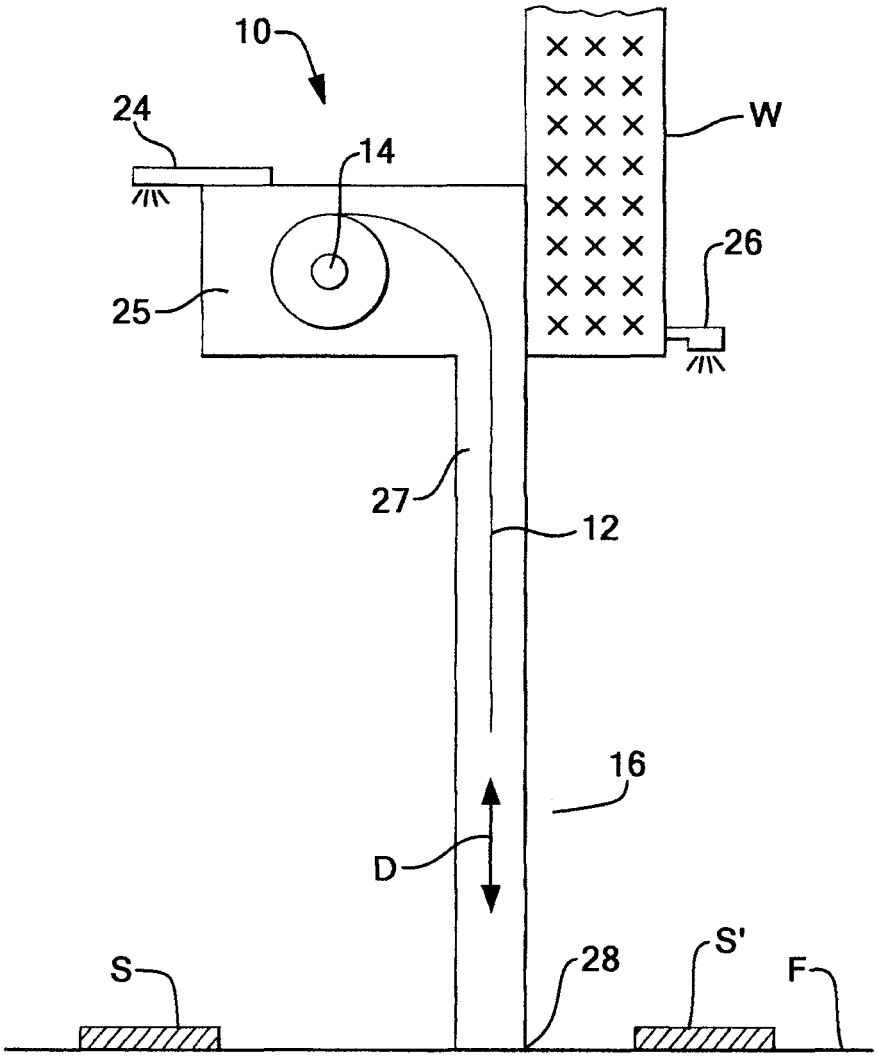
FIG. 3 shows a cross-section of the door assembly shown in FIG. 1 taken along the line A-A with areas S and S' indicated therein.

In conjunction with controlling motor 18, door controller 20 is configured to control a safety system 22 which includes at least a first light 24 positioned on a first side of doorway 16 (see for example FIG. 1 which shows a view from a first side of doorway 16). The safety system may also include a second light 26 positioned on a second side of doorway 16 (see for example. FIG. 2 which shows a view from a second side of doorway 16 with the side columns located behind wall W). Alternatively, as seen in FIGS. 4 and 5, a single light may be positioned proximate one side of, or in the middle of, doorway 16, with the single light being configured to emit and project light onto a surface proximate both sides of the doorway and door assembly during at least a portion of the opening and closing sequence.

Where two lights are used, each of first light 24 and second light 26 are positioned and configured to emit light which is directed towards and projected onto a first area or a second area, respectively, proximate a lower boundary 28 of doorway 16—for example light may be projected onto areas S and S' on floor F which forms the lower boundary of doorway 16 in FIGS. 1-3. The light emitted by each of first light 24 and second light 26 should be focused and clearly visible in any desired shape, pattern, or color on the side of the doorway on which each respective light is positioned when projected onto the first or second area. As seen in FIGS. 1-3 for example, each light may project a pattern of light onto an area of a surface proximate the doorway on each respective side of the door. Proximate the doorway may mean, for example, on the floor or other lower boundary (or any intervening objects or traffic) on each side of the doorway, at or adjacent or close to the edge of the doorway or door threshold, and/or outside the doorway and path of the door panel.

Figure 4:
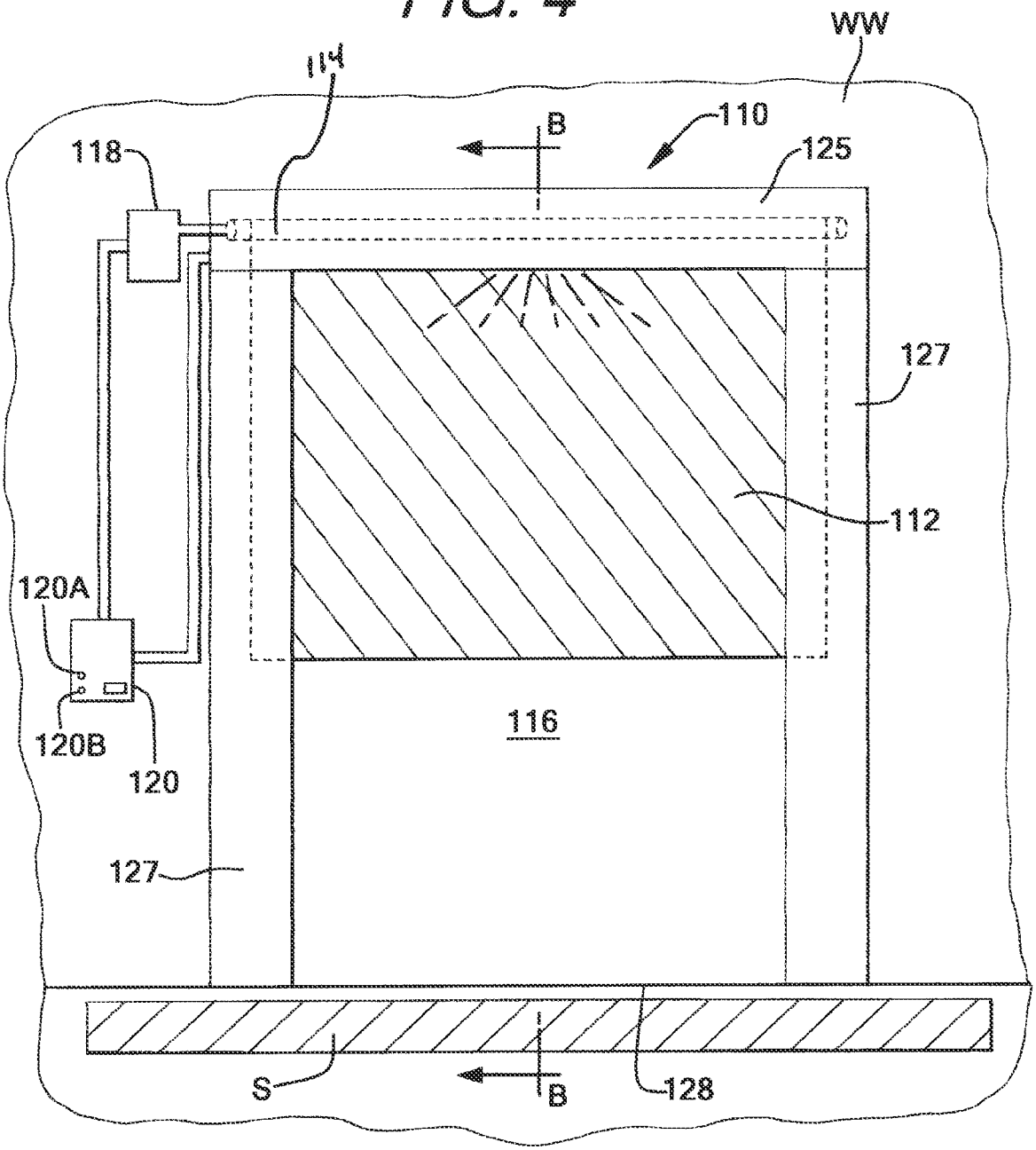
FIG. 4 shows a door assembly according to a second embodiment of the invention as seen when looking at a first side of a doorway opened and closed by the door assembly.
Figure 5:
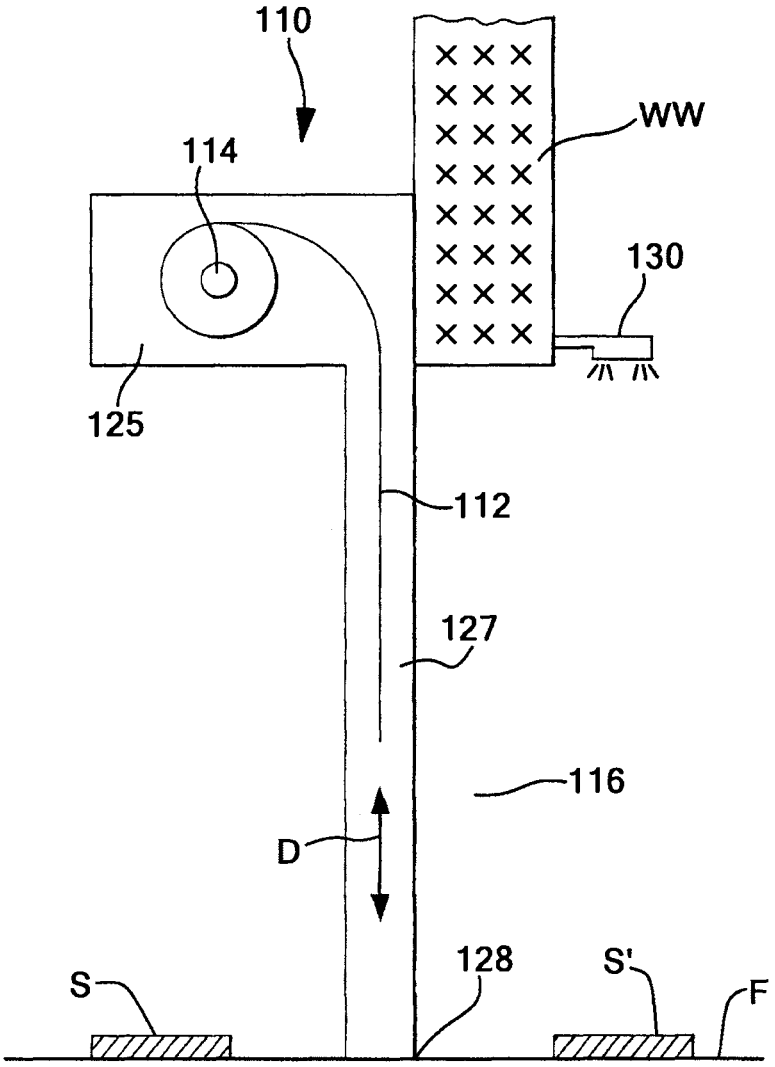
FIG. 5 shows a cross-sectional view of the door assembly in FIG. 4 taken along the line B-B.

The pattern of light which is projected may be, for example, in the shape of a strip, arc, rectangle, triangle, circle, semi-circle, or other shape, and have a width which extends at least the entire width of the doorway opening, and preferably extends beyond the width of the doorway, proximate to or along the wall or other barrier in which the doorway is formed as seen in FIGS. 1, 2, and 4, for example. The pattern may also, or alternatively, blink at one or more blinking rates, and/or may be a solid, unblinking projection which remains until the light is turned off.

The projection of light proximate the lower boundary of the doorway is preferably wider than door assembly 10 and doorway 16 so that light is projected onto a floor or other surface outside the width of the doorway. Projecting a pattern of light wider than the width of the doorway helps ensure that traffic approaching from a side of the doorway along or proximate a wall or other barrier in which the doorway is formed, rather than approaching the middle of the doorway, will likewise walk proximate to or through the light prior to reaching the doorway.

It is also preferable that areas S and S' be at least partially located outside an area directly beneath the door panel or in doorway so that traffic is required to pass through the projection of light prior to reaching the doorway and door assembly. If the pattern of light is projected proximate the doorway and door threshold, outside the door assembly and doorway, and extends across the width of the doorway or beyond, it is not necessary for any light to be provided within the area directly beneath or in the path of the door panel and/or doorway. Indeed, as shown in FIGS. 1-5 and FIGS. 3 and 5 in particular (which are cross-sections of FIGS. 1 and 4 respectively, with the portion of wall W or WW positioned directly behind the side columns removed for the sake of clarity), for example, no light may be projected in one or both of these areas—that is no light may be projected by either light (or a single light where used) within the doorway formed in the wall, or underneath or within the path D of the door panel as it opens and closes. Of course, light may be projected in the area directly underneath at least a portion of the door panel and in the path of the doorway as well.

Projecting the light downwards onto areas proximate lower boundary 28 of doorway 16, onto area S and S' of floor F for example, outside the doorway, and extending beyond the width of the doorway, allows traffic approaching the doorway from any direction to see any warnings or status indicators related to the door assembly. By directing the light downwards onto areas S and S' of the lower boundary of the doorway, or any objects or traffic positioned within area S or S' between first light 24 or second light 26 and the lower boundary of the doorway, traffic which may not be looking through the doorway as it approaches the doorway will be forced to walk through the light projection prior to reaching the doorway. For example, traffic which is looking down at a document or handheld device may be alerted to pending changes in the doors operational state as it approaches the doorway insofar as the light will be projected onto the traffic and any item the traffic might be looking as it approaches the doorway, before actually reaching the doorway and potentially walking underneath a closing door panel.

First light 24 and second light 26 may take any form known in the art which is capable of projecting a light onto a surface located proximate the doorway on an area of the lower boundary of the doorway. Examples include but are not limited to lasers, light emitting diodes (LEDs), or incandescent bulbs, or projector having any light emitting elements therein. Each light emitting element may include any reflector, refractor, lens, or optic which is utilized to project and focus the light as desired proximate the lower boundary of the doorway so that the light is clearly visible in the desired pattern to any traffic approaching the doorway.

Whatever form the light or lights take, the lights may be mounted directly to a portion of the door assembly or to the wall or barrier in which the doorway is formed. For example, on the first side or door assembly side as seen in FIG. 3, light 24 may attach directly to header or hood 25 of the door assembly or to side column 27 of the door assembly. Of course rather than attach to the door assembly, it is contemplated that even where a portion of the door assembly is available on one side of the doorway to attach light 24 or light 26, it is contemplated that the light may be attached to the wall or barrier in which the doorway is formed instead. Where the door assembly has no header or hood, or where the door assembly is located in the doorway, or where there is no header or hood or side columns available like on the second side or back side of the door shown in FIGS. 2 and 3, the light may likewise attach directly to the wall or barrier in which the doorway is formed, as seen with light 26 which is attached directly to wall W on the back or second side of the doorway.

While single lights may be described for each of first light 24 and second light 26, it should be understood that each light may include one or more lights or light elements which are capable of emitting light. For example, each of first light 24 or second light 26 may include multiple light emitting elements, like for example multiple LEDs, incandescent bulbs, lasers, or the like and/or multiple lights, or multiple projectors positioned on one side of the doorway with each light or projector projecting into the area S or S' proximate the lower boundary of the doorway.

As seen in FIGS. 4 and 5, it is contemplated that a single light or group of lights may be utilized in a safety system and door assembly rather than one or more lights positioned on each side of the doorway.

As seen in FIG. 4, door assembly 110 includes a door panel 112 which is wound and unwound from a drum 114 in order to open and close a doorway 116 formed in wall WW. In order to actuate drum 114, a motor 118 is provided which is capable of rotating drum 114 in a clockwise or counter-clockwise direction—rotation in one direction causing the door panel to wind onto the drum opening the doorway and rotation in the opposite direction causing the door panel to unwind from the drum closing the doorway. In order to control motor 118, a door controller 120 is provided which sends signals to the motor start or stop opening and closing sequences. Drum 114 and any unrolled portion of door panel 112 may be housed within a header 125, while the outer edges of door panel 112 may be guided in side columns 127.

Exemplary controllers which may be used for controller 120 in door assembly 110 include the System 3® and System 4® controllers sold by Rytec Corporation. Door controller 120 may be configured to receive or generate a signal to open or close the door panel, and in response to the receipt or internal generation of the signal, transmit a corresponding signal which activates motor 118 to actuate drum 114 to begin the appropriate sequence. Door controller 120 may be configured to receive a manual input to begin an opening or closing sequence, like for example as a result of a user pushing a corresponding button 120A, 120B on the controller or through the receipt of an infrared or wireless signal from a controller activated by a user. Door controller 120 may also (or alternatively) be configured to begin an opening sequence through the receipt of a signal from a sensor positioned proximate the door panel that traffic is approaching the door assembly, like for example a floor sensor, optical sensor, proximity sensor, motion sensor, pressure sensor, camera, or any other sensor which automatically detects traffic approaching the door. Door controller 120 may also (or alternatively) be configured to begin a closing sequence based on an internal clock or countdown after door panel 112 has been opened for a set period of time and no further "open" signal has been received by the door controller.

Rather than have two lights as seen in FIGS. 1-3, door assembly 110 includes a single light 130 which is positioned to emit light which is projected as pattern onto a surface proximate lower boundary 128 of doorway 116 on each side of the doorway. The single light may include any necessary light elements as well as reflectors, refractors, optics or lenses required to provide two separate indicators proximate the lower boundary. As seen in FIG. 5, the light emitted by device 130 may be projected onto surfaces S and S' on floor F on both sides of the doorway so that traffic from either direction can view the indicators at least prior to and during an initial movement phase of the door panel. A single light would operate in substantially the same manner as the dual lights in control and operation in response to signals received from door controller 120.

Figure 6:
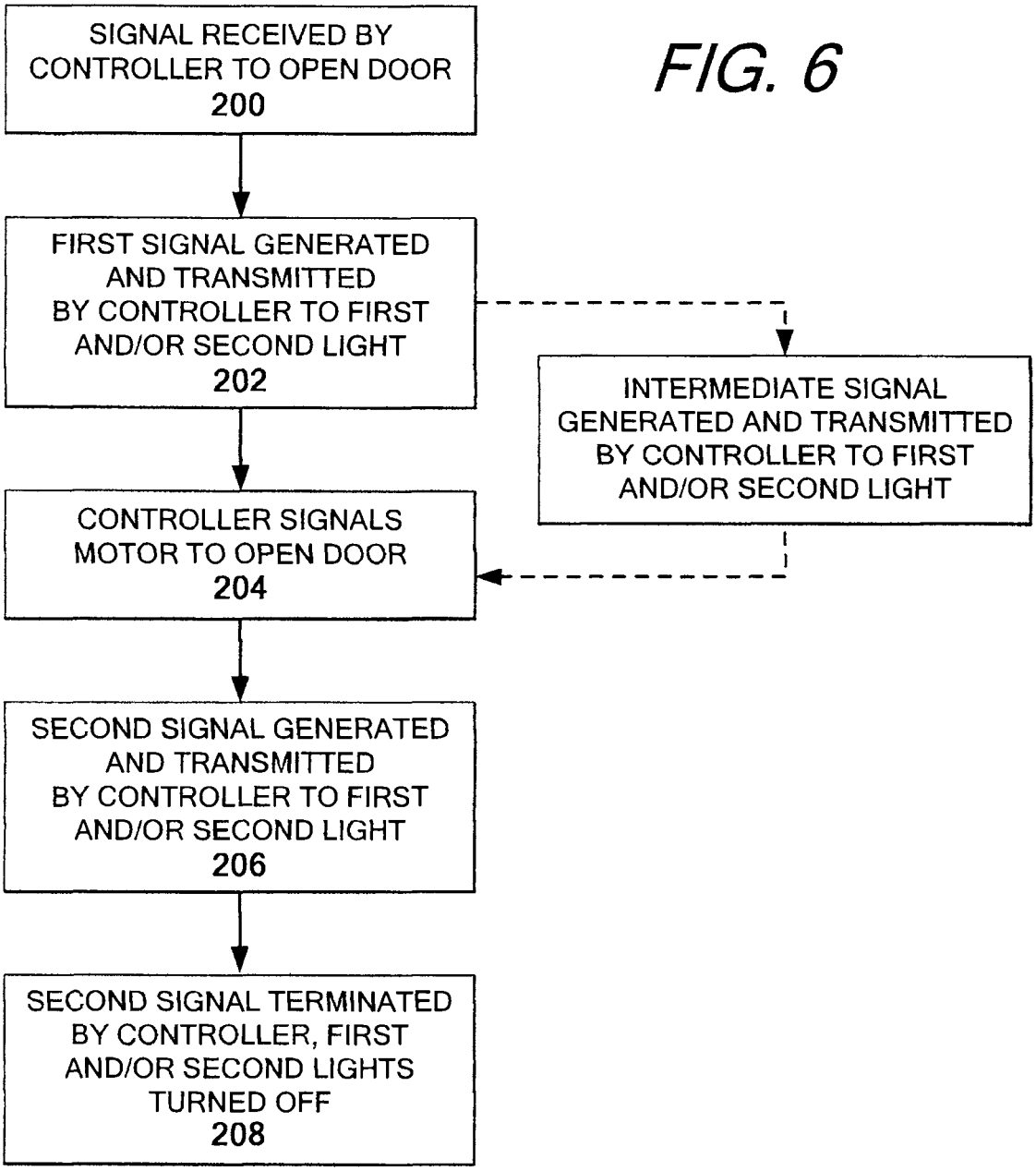
FIG. 6 shows a flow chart of an embodiment of a closing sequence for the door panel.
Figure 7:
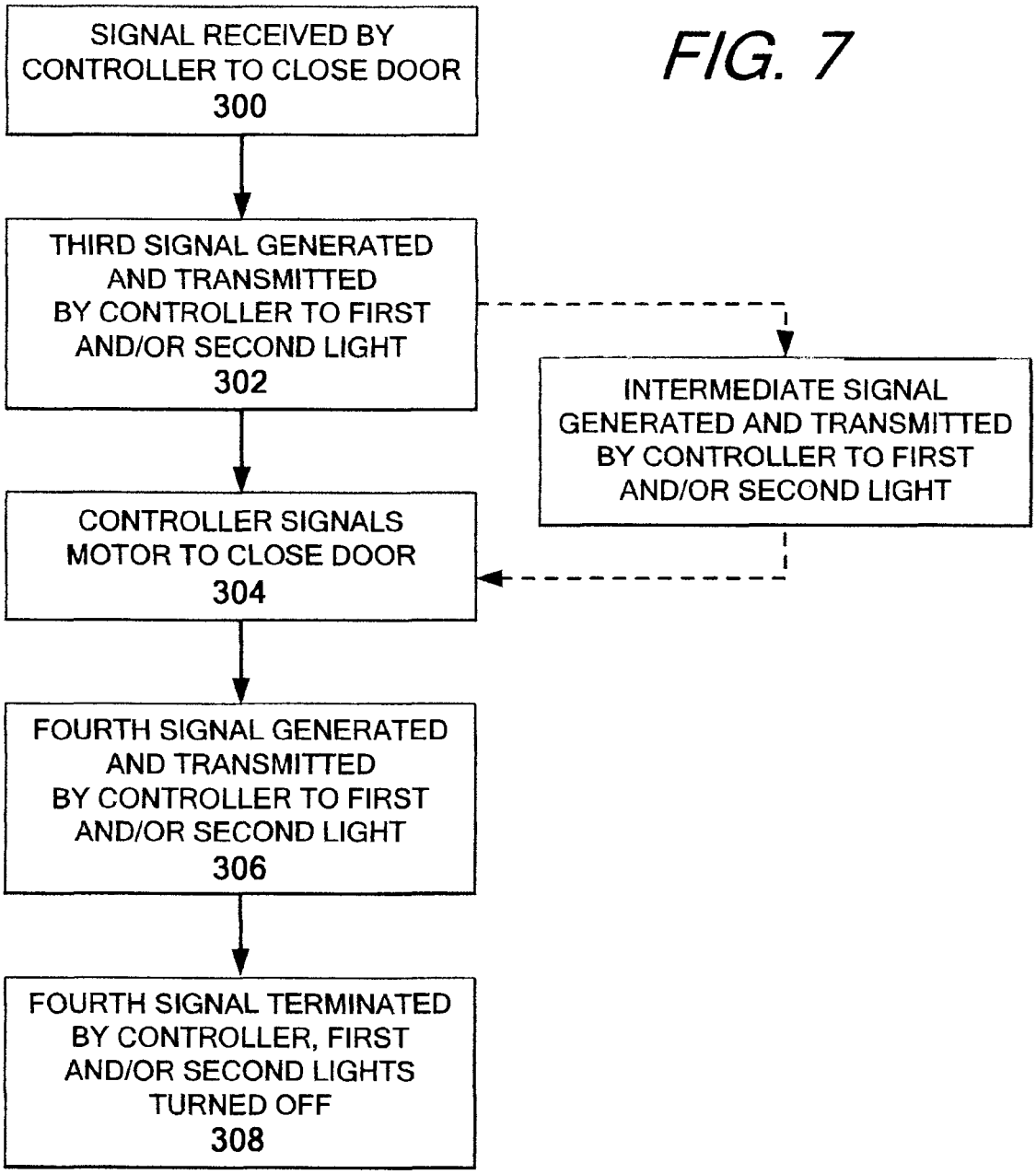
FIG. 7 shows a flow chart of an embodiment of an opening sequence for the door panel.

Control sequences of the motor and safety system by the door controller for the door assemblies shown in FIGS. 1-3 and FIGS. 4-5 can be seen in FIGS. 6 and 7 which detail and opening and closing, sequence respectively.

During an opening sequence, door controller 20 may control first light 24 and second light 26 in FIGS. 1-3 (or light 130 in FIGS. 4-5) as follows, as shown in FIG. 6. Upon receipt of a signal or instruction by door controller 20 (or 120) to open door panel 12 (or 112) from either a manual input or a sensor generated signal (step 200), the door controller may provide a first signal to each of the first light and the second light (or single light) to begin emitting light in a first pattern and/or color (step 202) prior to opening the door panel. The first signal may cause each of the first light 24 and second light 26 (or light 130) to, for example, begin projecting a first pattern (for example blinking at a first rate and/or in a first shape) and/or color of light on areas of a surface forming the lower boundary of the doorway proximate its respective side of the doorway to notify any approaching traffic that the door panel is about to change operation and begin opening. The first signal from the door controller to the first light and the second light (or the single light) and the resulting emitted and projected light may remain constant, whether blinking, in a specific shape, and/or in a first color or intensity prior to the door controller sending a signal to activate motor 18 (or 118) to actuate drum 14 (or 114) to open the door (step 204). As the controller activates the motor, a second signal is generated and sent to the first and second (or single light) (step 206). Where a single light is used, if positioned to one side of the doorway, the door panel may block the projection from reaching the floor or other lower boundary on the opposing side of the doorway. A window or clear area may be provided in the door panel to facilitate the transmission of light to the opposing side of the door panel when the door panel is closed in such embodiments.

Prior to sending an open signal to motor and a second signal to the first and second (or single) light, however, an intermediate signal may optionally be transmitted from door controller 20 (or 120) to first light 24 and second light 26 (or single light 130) to cause the emitted light to be projected onto a surface forming the lower boundary of the doorway in a modified pattern and/or color or intensity immediately prior to the door opening.

For example, where an instruction or signal is received by the door controller to open the door panel, the door controller may generate an internal signal based on an internal clock to delay opening for 5 seconds after the signal is received. In such instances the first signal may be immediately transmitted to the first and second lights (or single light) by the door controller upon receipt of the open instruction, with the first signal causing light emitted by each of the first light and the second light (or the single light) to be a strip of light which blinks at a first rate and/or in a first shape and/or as a first color light for 3 seconds, with an intermediate signal being generated and transmitted to the first light and the second light (or the single light) to cause the emitted light to blink at the same or a faster rate, in the same or a different shape, and/or be emitted and projected as the same or a modified color of light for the final 2 seconds before the door controller activates the motor and winding of the door panel on the drum begins.

Whether immediately after the first signal, or after an intermediate signal, once door controller 20 (or 120) sends a signal to motor 18 (or 118) to actuate the drum to wind the door panel 12 (or 112) and open the door (step 204), a second signal may be sent to each of first light 24 and second light 26 (or light 130) (step 206) to emit and project a second pattern and/or color of light. Upon receipt of the second signal from the door controller, each of the first light and the second light (or the single light) may, for example, begin projecting a second pattern and/or color of light on a surface forming the lower boundary of the doorway proximate the threshold of the doorway on its respective side. Once the door panel is opened, the door controller may terminate the second signal to the first light and the second light (or the single light) (step 208), resulting in both lights being deactivated while the door remains opened until the closing sequence begins.

During a closing sequence, door controller 20 (or 120) may control first light 24 and second light 26 (or single light 130) as follows. Upon receipt of a control signal to close door panel 12 (or 112), or internal generation of a signal or instruction by the door controller to close door panel (step 300), the door controller may provide a third signal to the first light and the second light (or the single light) to begin emitting and projecting light in a third pattern and/or color (step 302) onto a surface forming the lower boundary of the doorway prior to closing the door panel. Each of the first light and the second light (or the single light), may, for example, begin projecting a pattern of light onto a surface, such as a floor, proximate the lower boundary of the doorway which is a strip or other shape of blinking or non-blinking light proximate the respective side or threshold of the doorway, to notify any approaching traffic that the door panel is about to close. The third signal from the door controller to the first light and the second light (or the single light) and the resulting light emission and projection by the first and second lights (or the single light) may remain constant before the door controller sends a signal to activate motor 18 (or 118) to actuate drum 14 (or 114) to close the door.

Rather than remain constant until closing begins, an intermediate signal may optionally be generated and transmitted from the door controller to the first light and the second light (or the single light) to cause the pattern projected light to change, for example to cause the projected light to change shapes, and/or blink at a modified rate, and/or to modify the color or intensity of the emitted light, immediately prior to the door closing.

For example, where a signal is received to close the door panel and the controller utilizes a 30 second delay, or an internal signal is generated by the door controller based on an internal clock set to activate the motor to begin the closing the door panel 30 seconds after the door is fully opened, the third signal may be transmitted by door controller to the first and second lights (or the single light) after the first 10 seconds, with the third signal causing light emitted by each of the first light and the second light (or the single light) to be projected as a light blinking at a third rate, and/or third shape, and/or be emitted as a third color light for the second 10 seconds. An intermediate signal may be generated for the final 10 seconds before the door controller activates the motor to lower the door panel, with the intermediate signal causing the pattern of the projected light to change shape and/or blink at a different blinking rate and/or be projected as a modified color light for the third 10 seconds before the door panel is closed. Of course, it should be understood that one or more of a blinking rate, a shape change, and/or color change of the emitted light may occur when the intermediate signal is sent to the first and second (or single) light. The intermediate signal may continue until the door closing sequence begins.

Once door controller 20 (or 120) sends a signal to motor 18 (or 118) to actuate the drum 14 (or 114) to unwind the door panel 12 (or 112) and close the door (step 304) after the third signal or any intermediate signal, a fourth signal may be sent to each of first light 24 and second light 26 (or single light 130) (step 306) to emit a fourth pattern and/or color of light. Once door panel 12 is closed, the door controller may terminate the fourth signal to the first light and the second light (or the single light) (step 308) resulting in the lights being deactivated while the door remains closed until an opening sequence begins.

In order to simplify the system, it is contemplated that the first and third light pattern and/or color, and/or the second and fourth light pattern and/or color may be the same. In such instances, the first and third pattern and/or color of light may be used to indicate any impending operational status change to the door panel, i.e. the door is about to operate or move, while the second and fourth light pattern and/or color indicate that the door is operating or moving.

As discussed herein, between any signals and intermediate signals, the light projected into areas S and S' may change pattern, may change color, or may change both pattern and color.

Any change in color of light when switching between first, second, third, fourth, and any intermediate signals should be understood to mean that the light which is projected into areas S and S' changes colors. For example, during a closing sequence, when the third signal is transmitted from the door controller to the first and second lights (or the single light), the light may initially be projected as a yellow light. Where an intermediate signal is used prior to the fourth signal, the intermediate signal may cause the first and second lights (or the single light) to project a pattern of light in an orange color. When the fourth signal is then transmitted from the controller to the first and second lights (or the single light), the first and second lights (or the single light) may begin projecting a pattern of light in a red color.

Any change in pattern resulting from a change between the first, second, third, fourth and any intermediate signals may include a change in either the shape of the pattern projected, for example switching from a strip or rectangle to an arc to a filled in semi-circle. A change in pattern may also, or alternatively, change the phase of the projected light, for example switching from a slowly blinking projection, to a faster blinking projection, to a solid unblinking projection. Changing the pattern of projected light, particularly where the shape of the pattern is changed, may indicate safe zones or areas in which traffic should remain based on the operation status or impending changes in operational status of the door panel—for example an arc indicating an area which traffic should not enter, or a filled in semi-circle indicating an area where traffic should immediately evacuate.

It should be understood that the closing sequence may be interrupted at any time by any safety devices linked to door controller 20 (or 120) and located proximate the doorway to detect traffic or objects approaching the doorway once a closing sequence has begun. For example, detection of traffic by safety systems such as single or multiple photo-eye sensors like those described in U.S. Pat. Pub. No. 2017/0074039 to Rytec Corporation may cause the door controller to stop any closing sequence and open the door panel or hold the door panel in place until a clear signal is received from the sensor to allow the door controller to begin a new closing sequence. In the event that the door controller has not activated motor 18 (or 118) and door panel 12 (or 112) has not begun closing, the door controller may simply stop transmitting the third signal and/or restart any internal signal countdown clock or await a second manual close signal once the sensor indicates the traffic has left the area proximate the door assembly.

In the event that the door controller has activated the motor and the door panel has begun closing, activation of a single or multiple photo-eye sensor, or a sensor positioned on the door panel indicating that a portion of the door panel has impacted an object or traffic like for example a bottom bar sensor, will cause the door controller to immediately switch from a close signal to an open signal. In such a sequence, the door controller will immediately activate the motor to wind the door panel to open the door, and send the second signal to the first light and the second light (or the single light) to emit the second pattern and/or color to indicate that the door panel is opening.

A fifth signal may also be generated and transmitted by door controller 20 (12) and provided to first light 24 and second light 26 (or single light 130) for each of the first light and the second light (or the single light) to emit light in a fifth pattern and/or color upon detection of a fault in the system. For example, if door panel 12 (or 112) becomes disengaged or motor 18 (or 118) fails, the door controller may send a fifth signal to each of the first light and the second light (or the single light) to emit and project a light in a fifth pattern and/or color, different each pattern and/or color emitted and projected in response to any of the first, second, third, fourth, and intermediate signals from the door controller. The fifth pattern or color may likewise be projected onto a surface forming the lower boundary of the doorway to indicate a fault with the door assembly.

While in the foregoing there has been set forth preferred embodiments of the invention, it is to be understood that the present invention may be embodied in other specific forms without departing from the spirit or central characteristics thereof. The present embodiments, therefore, are to be considered in all respects as illustrative and not restrictive, and the invention is not to be limited to the details given herein. While specific embodiments have been illustrated and described, numerous modifications come to mind without significantly departing from the characteristics of the invention and the scope of protection is only limited by the scope of the accompanying claims.

What is claimed is:

1. A method of increasing safety for overhead roll-up doors comprising:

providing a first light on a first side of a doorway opened and closed by a door panel;

positioning the first light to project light onto a first area proximate a lower boundary of the doorway proximate the first side of the doorway; and controlling the first light so that the first light projects light onto the first area in conjunction with the door panel opening and closing the doorway, wherein the first light is controlled by transmitting a first signal generated by a controller to the first light when an instruction to open the door panel is received, wherein the first signal causes the first light to emit light in one or more a first pattern or color prior to the door panel opening;

transmitting a second signal generated by the controller to the first light when the door panel begins opening, wherein the second signal causes the first light to emit light in one or more a second pattern or color while the door panel is opening;

transmitting a third signal generated by the controller to the first light when an instruction to close the door panel is received, wherein the third signal causes the first light to emit light in one or more a third pattern or color prior to the door panel closing; and transmitting a fourth signal generated by the controller to the first light when the door panel begins closing, wherein the fourth signal causes the first light to emit light in one or more a fourth pattern or color while the door panel is closing.

2. The method of claim 1, further comprising the steps of:

projecting a second light from the first light onto a second area proximate the lower boundary of the doorway proximate a second side of the doorway; and controlling the second light so that the second light is projected onto the second surface in conjunction with the door panel opening and closing the doorway.

3. The method of claim 1, further comprising the steps of:

providing a second light on a second side of the doorway;

positioning the second light to project light onto a second area proximate the lower boundary of the doorway proximate the second side of the doorway; and controlling the second light so that the second light projects light onto the second area in conjunction with the door panel opening and closing the doorway.

4. The method of claim 3, further comprising the steps of transmitting the first signal generated by a controller to the second light when an instruction to open the door panel is received, wherein the first signal the second light to emit light in one or more of the first pattern or color prior to the door panel opening;

transmitting the second signal generated by the controller to the second light when the door panel begins opening, wherein the second signal causes the second light to emit light in one or more of the second pattern or color while the door panel is opening;

transmitting the third signal generated by the controller to the second light when an instruction to close the door panel is received, wherein the third signal causes the second light to emit light in one or more of the third pattern or color prior to the door panel closing; and transmitting the fourth signal generated by the controller to the second light when the door panel begins closing, wherein the fourth signal causes the second light to emit light in one or more of the fourth pattern or color while the door panel is closing.

5. The method of claim 4, wherein the first pattern or color and the third pattern or color are identical, and the second pattern or color and the fourth pattern or color are identical.

6. The method of claim 4, further comprising the step of transmitting a fifth signal generated by the controller to the first light and the second light when a system fault is detected, wherein the fifth signal causes the first light and the second light to emit light in one or more of a fifth pattern or color until the system fault is resolved.

7. The method of claim 4, further comprising the step of transmitting an intermediate signal generated by the controller to the first light and the second light, the intermediate signal being generated after the first signal and modifying one or more of the first pattern or color of light emitted by the first light and the second light.

8. The method of claim 4, further comprising the step of transmitting an intermediate signal generated by the controller to the first light and the second light, the intermediate signal being generated after the third signal and modifying one or more the third pattern or color of light emitted by the first light and the second light.

9. The method of claim 1, wherein the first pattern or color and the third pattern or color are identical, and the second pattern or color and the fourth pattern or color are identical.

10. The method of claim 1, further comprising the step of transmitting a fifth signal generated by the controller to the first light when a system fault is detected, wherein the fifth signal causes the first light to emit light in one or more a fifth pattern or color until the system fault is resolved.

11. The method of claim 1, further comprising the step of transmitting an intermediate signal generated by the controller to the first light, the intermediate signal being generated after the first signal and modifying one or more of the first pattern or color of light emitted by the first light.

12. The method of claim 1, further comprising the step of transmitting an intermediate signal generated by the controller to the first light, the intermediate signal being generated after the third signal and modifying one or more of the third pattern or color of light emitted by the first light.

* * * * *